United States Patent [19]

Kobayashi et al.

[11] 4,363,958

[45] Dec. 14, 1982

[54] PREHEATING APPARATUS FOR DIESEL ENGINES

[75] Inventors: Akihiro Kobayashi, Aichi; Masashi Kida; Yoji Kato, both of Okazaki, all of Japan

[73] Assignee: Nippon Soken, Inc., Nishio, Japan

[21] Appl. No.: 228,552

[22] Filed: Jan. 26, 1981

[30] Foreign Application Priority Data

Jan. 29, 1980 [JP] Japan ..... 55-9556

[51] Int. Cl.³ ..... H05B 1/02

[52] U.S. Cl. ..... 219/505; 123/179 H; 219/205; 219/519; 219/342; 219/366; 219/494

[58] Field of Search ..... 219/497, 339, 492, 342, 219/514, 494, 519, 506, 504, 505, 205, 206, 207; 123/179 H, 179 B, 179 BG

[56] References Cited

U.S. PATENT DOCUMENTS

| | | | |
|---|---|---|---|
| 3,651,308 | 3/1972 | Kurokawa et al. | 219/505 |
| 3,666,924 | 5/1972 | Jensen et al. | 219/505 |
| 3,798,413 | 3/1974 | Kahn | 219/505 |

FOREIGN PATENT DOCUMENTS

| | | | |
|---|---|---|---|
| 2306372 | 8/1974 | Fed. Rep. of Germany | 123/179 H |
| 2734718 | 2/1978 | Fed. Rep. of Germany | 123/179 H |
| 52-48262 | 11/1977 | Japan . | |

*Primary Examiner*—M. H. Paschall

*Attorney, Agent, or Firm*—Cushman, Darby & Cushman

[57] ABSTRACT

A parallel circuit of an ordinary resistor exhibiting an ordinary resistance characteristic and a starting resistor abruptly increasing its resistance at a certain temperature is inserted between glow plugs in a Diesel engine and a battery. The resistance of the starting resistor is smaller than that of the ordinary resistor at a normal temperature. The resistance of the starting resistor becomes larger than that of the ordinary resistor when a large amount of current flows through the starting resistor. Therefore, current flows from the battery to the glow plugs mainly through the starting resistor at first, and then it flows mainly through the ordinary resistor. The ordinary resistor is disposed in an intake air passage of the engine.

9 Claims, 16 Drawing Figures

PREHEATING APPARATUS FOR DIESEL ENGINES

BACKGROUND OF THE INVENTION

The present invention is related to co-pending U.S. application entitled "PREHEATING APPARATUS FOR DIESEL ENGINES" filed on Oct. 9, 1980 in the name of Yoji KATO and assigned to the same assignee.

The present invention relates to a preheating apparatus for Diesel engines, which is designed so that the glow plugs of an engine are provided with a rapid temperature rise characteristic and the air drawn into the engine is also heated with a view to improving the starting characteristic of the engine.

In the past, Diesel engines of the pre-combustion chamber type have been mostly equipped with glow plugs for engine starting facilitating purposes so that during the engine starting the glow plugs are heated red hot and the fuel is contacted with the glow plugs to burn it and thereby facilitate the starting of the engine. There has been a desire that the time required for heating the glow plug red hot (hereinafter referred to as a "glow plug preheating time") and the time required for starting the engine through the operation of the starter (hereinafter referred to as a "cranking time") be reduced as far as possible.

In view of these background circumstances, systems have been proposed in which as shown, for example, in Japanese Utility Model Publication No. 48262/77, in order to reduce the preheating time, a resistance unit having a very high positive temperature coefficient of resistance, such as one made from molybdenum disilicide, is connected in series with a parallel circuit of glow plugs so that during the starting period a large current is supplied to the glow plugs through the action of the resistance unit and the temperature of the glow plugs is increased rapidly.

However, the prior art apparatus of the above type has the following disadvantages.

(1) While the molybdenum disilicide resistor constituting the resistance unit increases in resistance value linearly with temperature, the ratio of change in resistance between the lower and higher temperature ranges is about 6 times so that the resistance value at the normal temperature becomes 1/6 of the resistance value in the higher temperature range and thus the normal temperature resistance value cannot be set so small. This limits the amount of starting current that can be supplied to the glow plugs and the resulting preheating time is 15 seconds as compared with the conventional time of 20 seconds, showing only an improvement by 25%.

(2) When the current is being supplied to the glow plugs, the current is always flowing to the molybdenum disilicide resistance unit so that the resistance unit always generates heat and the resistance unit is always kept at elevated temperatures by this heat generation, causing its characteristics to change greatly with time. Thus, there is a disadvantage that even if the initial resistance value is preset accurately, the resistance value is subject to variation with the accumulated period of service time of the glow plugs, thus giving rise to such troubles as burnout failure, faulty heat generation, etc., of the glow plugs.

SUMMARY OF THE INVENTION

With a view to overcoming the foregoing deficiencies in the prior art, it is an object of the present invention to provide an improved preheating apparatus which is capable of remarkably reducing the preheating time of the glow plugs of Diesel engines than previously.

It is another object of the present invention to provide an improved preheating apparatus which is capable of preventing burnout failure of the Diesel engine glow plugs.

To accomplish the above objects, the preheating apparatus provided in accordance with the present invention preferably includes glow plugs mounted in a Diesel engine, a starting resistor unit made from a barium titanate ceramic material having a positive resistance temperature coefficient and whose resistance value abruptly increases at a specified temperature, the resistor unit being connected in the energization circuit of the glow plugs, and an ordinary resistor unit connected in parallel with the starting resistor unit, wherein the starting resistor unit has a resistance value which is smaller than that of the ordinary resistor unit when the temperature of the glow plugs themselves is relatively low and which is greater than that of the ordinary resistor unit when the glow plug temperature is relatively high, the ordinary resistor unit being disposed in the intake air passage of the engine.

It is still another object of the present invention to provide an improved preheating apparatus which is capable of greatly reducing the cranking time of a Diesel engine.

The above object is accomplished preferably by disposing the ordinary resistor unit in the intake air passage of a Diesel engine.

In accordance with the present invention, a starting resistor unit is mainly composed of barium titanate ($BaTiO_3$), and it is produced by adding to this main component such impurities as manganese (Mn), strontium (Sr), lead (Pb), cerium (Ce), etc., and baking the mixture.

This barium titanate type resistor unit has a positive temperature coefficient of resistance as shown in FIG. 2, and has a resistance value which becomes 0.0076 ohms at the ordinary temperature (25° C.) and which at a temperature of about 170° C. abruptly increases to about 10 ohms. This ratio of change of resistance value is about 1,000 times. While the temperature at which the resistance value abruptly increases (hereinafter referred to as a Curie point) and the ratio of change of resistance are adjustable in dependence on the amount of impurities added to the barium titanate, generally the Curie point and the ratio of change of resistance of this type of resistor unit are mostly on the order of about 100° to 300° C. and 1,000 times, respectively. As a result, the barium titanate type starting resistor unit of this invention can have its ordinary temperature resistance value set to one which is very small as compared with that of the prior art molybdenum disilicide resistor, thus increasing the starting current flow to the plugs and remarkably reducing the preheating time of the glow plugs than previously.

In accordance with the present invention, an ordinary resistor unit is composed for example of an ordinary metal resistance wire such as a tungsten wire, nichrome wire, copper wire, iron wire or SUS wire, and this resistor unit is disposed in the intake air passage of an engine as will be described later.

In accordance with the present invention, the following relationship exists between the resistance values of the ordinary and starting resistor units. In other words, the starting resistor unit has a resistance value which is smaller than that of the ordinary resistor unit when the temperature of the glow plug itself is in the lower range and which is greater than that of the ordinary resistor unit when the glow plug temperature is in the higher range. To cite a specific example, if it is selected so that the resistance value of the starting resistor unit becomes 1/10 of that of the ordinary resistor unit when the glow plug temperature is in the lower range and the resistance value of the starting resistor unit becomes over 10 times that of the ordinary resistor unit when the glow plug temperature is in the higher range, it is possible to ensure a satisfactory rapid glow plug heating effect and it is also possible to provide the glow plugs with the necessary current for normal operation through the ordinary resistor unit when the normal condition is established or when the glow plugs are heated to a high temperature which is enough for preheating purposes. Therefore, the resistance ratio between the two resistor units must be about 100 times.

In accordance with the present invention, "the higher temperature range of the glow plug itself" represents in fact the surface temperatures of the glow plug which are higher than 700° C. and "thus lower temperature range" represents the surface temperatures lower than 700° C. Of course, the required glow plug temperature for preheating purposes differs with different types of engines and thus the temperatures represented by the lower and higher temperature ranges vary correspondingly. If they are defined for purposes of discussion, the higher temperature range represents the temperatures higher than that required for igniting the fuel in the engine combustion chamber and the lower temperature range represents those lower than the required fuel igniting temperature.

In this connection, since the time constant for the glow plug temperature to reach a temperature necessary to ignite the fuel in the combustion chamber is selected substantially equal to the time constant for the starting resistor unit to attain the Curie point, considering from the standpoint of the starting resistor unit "the lower temperature range" represents the temperatures lower than the Curie point and "the higher temperature range" represents those which are higher than the Curie point.

The present invention is also applicable to single-cylinder Diesel engines. Of course, where the present invention is applied to a multi-cylinder Diesel engine, a starting resistor unit may be connected to each of the glow plugs in the respective cylinders of the engine.

These and other objects, features and advantages of the present invention will be apparent from the following description taken in conjunction with the accompanying drawings, in which:

DESCRIPTION OF THE PREFERRED EMBODIMENTS

The present invention will now be described in greater detail with reference to the illustrated embodiments.

Figure 1:
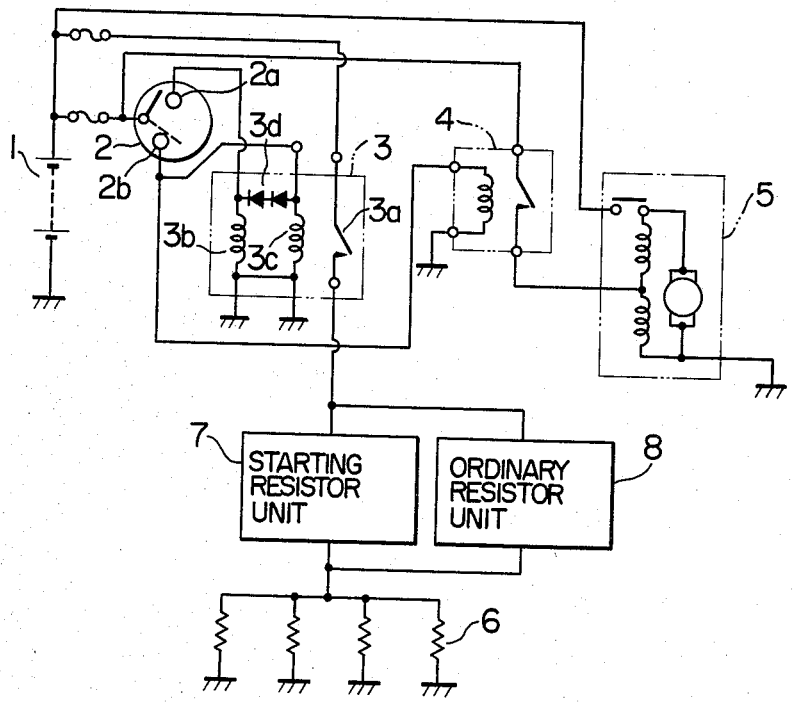
FIG. 1 is a wiring diagram showing an embodiment of a preheating apparatus according to the present invention.
Figure 2:
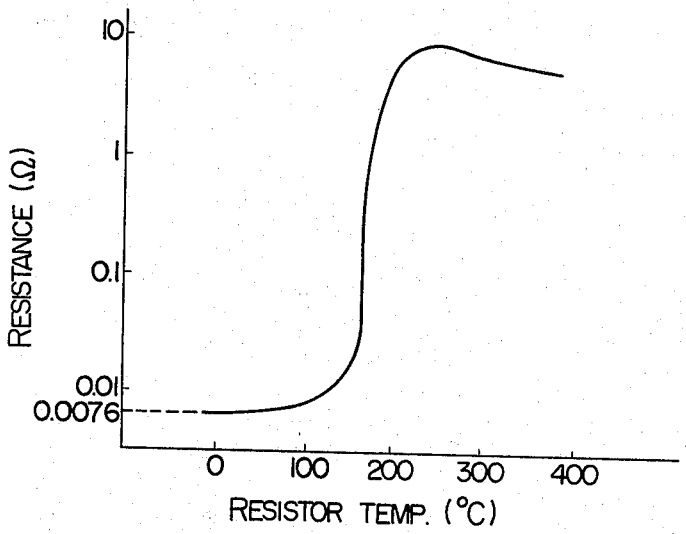
FIG. 2 is a characteristic diagram of the resistor unit 7 shown in FIG. 1.

Referring to FIG. 1, numeral 1 designates a battery forming a vehicle-mounted power source, 2 a starter switch, **2*a* a preheating contact, and 2*b* a starting contact. Numeral 3 designates a glow plug relay, 3*a* a normally open contact, 3*b* and 3*c* coils, and 3*d* reverse current blocking diodes. Numeral 4 designates a starter relay, and 5 a starter. Numeral 6 designates glow plugs of the known sheathed structure (not shown in detail) in which a heat coil is contained within a heat resisting metal tube through the intermediary of electrical insulating powder. The glow plugs 6 are each mounted in one of the cylinder pre-combustion chambers of a Diesel engine, and a plurality, e.g., four, of the glow plugs 6 are connected in parallel with each other. Numeral 7 designates a starting registor unit made from the previously mentioned barium titanate ceramic and it has a characteristic as shown in FIG. 2. Its Curie point is about 170° C. and it has a resistance value of about 0.0076 ohms until reaching the Curie point at which the resistance value increases to 10 ohms. The single resistor unit 7 is connected in series with the parallel circuit of the glow plugs 6**.

Figure 3:
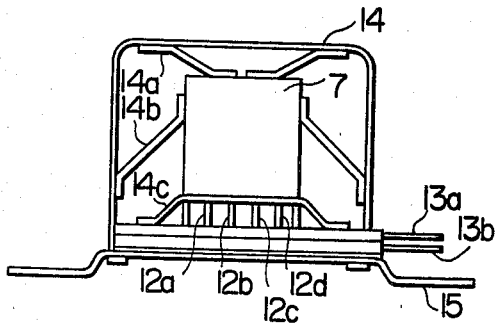
FIG. 3 is an assembly drawing of the resistor unit 7 shown in FIG. 1.
Figure 4:
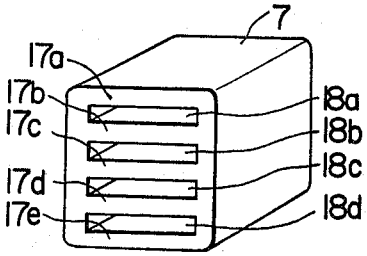
FIG. 4 is a perspective view of the resistor unit 7 of FIG. 3.
Figure 5:
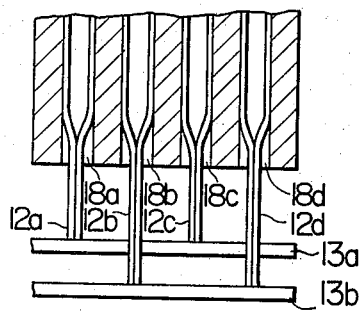
FIG. 5 shows the external connection structure of the lead wires for the resistor unit 7 of FIG. 3.

Next, the construction of the starting resistor unit 7 will be described in greater detail with reference to FIGS. 3 to 5. FIG. 3 shows the entire assembly of the starting resistor unit assembled in a case, and the assembly includes the starting resistor unit 7, lead wires **12*a* to 12*d* electrically connected to the starting resistor unit 7, terminals 13*a* and 13*b* to which the lead wires 12*a* to 12*d* are alternatively tied and which are combined in a pair, a metallic case 14 in which the starting resistor unit 7 is held in place and protected by leaf springs 14*a*, 14*b* and 14*c* and a stay 15 for holding the entire assembly and attaching it to the engine body or its vicinity. More specifically, the starting resistor unit 7 has a honeycomb structure as shown in FIG. 4 in which barium titanate elements or isolating walls 17*a* to 17*e* of rectangular plate shape are arranged one upon another to define spaces or passages 18*a* to 18*d* therebetween. Thin electrode films (not shown) made by baking silver paste are formed on the resistor portions facing the spaces 18*a*** to 18*d*. As shown in FIG. 5, the lead wire 12*a* made by processing a metal sheet and plated with silver is placed in contact through the silver paste thin electrode films with the resistor portions facing the space 18*a* and the other end of the lead wire 12*a* is connected to the terminal 13*a*. In like manner, the lead wires 12*b*, 12*c* and 12*d* are respectively placed in contact through the silver paste electrode films with the resistor portions facing the spaces 18*b*, 18*c* and 18*d* and their other ends are respectively connected to the terminals 13*b*, 13*a* and 13*b*. One of these terminals 13*a* and 13*b* is connected to the glow plugs 6 and the other is connected to the glow plug relay contact 3*a*.

Figure 6:
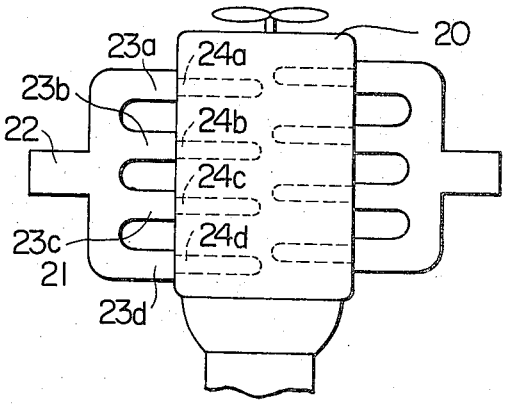
FIG. 6 is a plan view of the Diesel engine.
Figure 7:
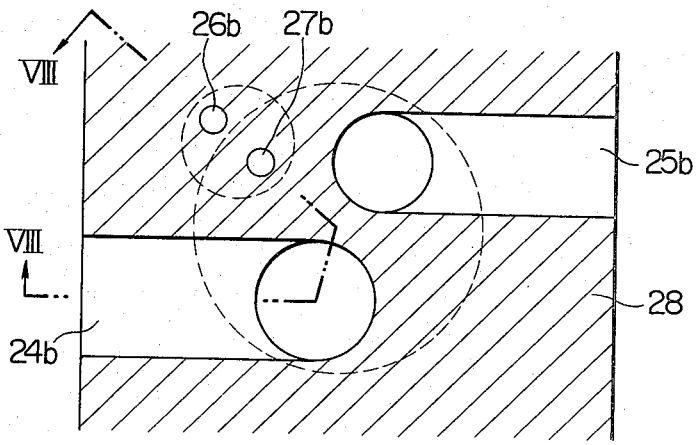
FIG. 7 is a sectional view of the No. 2 cylinder of the Diesel engine.

Next, the mounting position and construction of an ordinary resistor unit 8 will be described. FIG. 6 is a plan view of a Diesel engine, in which numeral 20 designates a Diesel engine, 21 an intake manifold, 22 an intake manifold converging portion, 23*a* and 23*d* intake manifold branches, and 24*a* to 24*d* intake ports in the cylinder head. FIG. 7 is an enlarged view showing one of the cylinders, the No. 2 cylinder of the Diesel engine shown in FIG. 6 and shown in FIG. 7. The manifold is not shown. In FIG. 7, numeral 28 designates the cylinder head, 24*b* the intake port, 25*b* an exhaust port, 26*b* a fuel injection pump, and 27*b* a glow plug.

Figure 8:
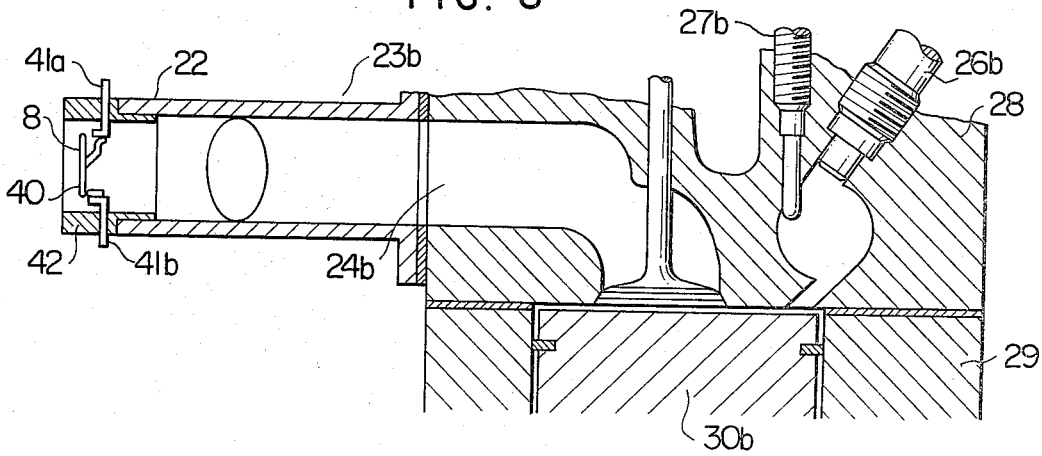
FIG. 8 is a sectional view taken along the line VIII—VIII of FIG. 7.
Figure 9:
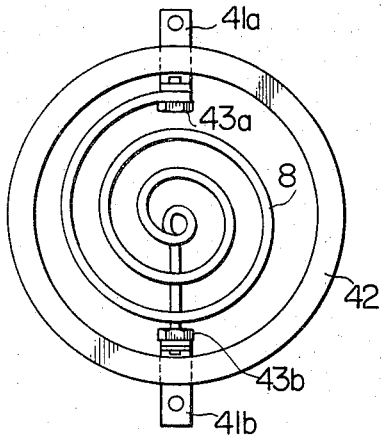
FIG. 9 is an assembly diagram of the resistor 8 shown in FIG. 8.

FIG. 8 is a sectional view taken along the line VIII—VIII of FIG. 7. In FIG. 8, numeral 29 designates the cylinder block, and 30*b* a piston. Numeral 40 designates an ordinary resistor unit assembly whose detailed construction is shown in FIG. 9. More specifically, the ordinary resistor unit 8 is wound into a helical form and the resistor unit 8 has its one end fastened to a terminal 41*a* by a bolt 43*a* and its other end fastened to a terminal 41*b* by a bolt 43*b*. The terminals 41*a* and 41*b* are secured to a stay 42 made from an insulating material such as Bakederlin (trade name) by such means as bolts (not shown), adhesive or molding integrally. The stay 42 is secured to the intake manifold converging portion 22 by bolts or screws (not shown). One of the terminals 41*a* and 41*b* is connected to the glow plugs 6 and the other is connected to the glow plug relay contact 3*a*.

With the construction described above, the operation of the embodiment is as follows. When the switch 2 is operated to close the preheating contact 2*a*, the current flows from the battery 1 to the coil 3*b* of the glow plug relay 3 so that an attractive force is produced in the coil 3*b* and the contact 3*a* is closed. At this time, since the preheating is necessary and hence the temperature of the glow plugs 6 is low as a matter of course, the resistance value of the starting resistor unit 7 is 0.0076 ohms which is considerably lower than the resistance value of the ordinary resistor unit 8 which is 0.068 ohms. As a result, the current from the battery 1 flows to the glow plugs 6 through the contact 3*a* of the glow plug relay 3 and the starting resistor unit 7 causing the glow plugs 6 generate heat. In this case, due to the fact that immediately after the beginning of the current flow the resistor unit 7 is not generating heat and also its resistance value is very small, a large current flows to the glow plugs 6. While the resistor unit 7 generates heat as the conduction time passes, as will be seen from the characteristic diagram of FIG. 2, the resistance value of the resistor unit 7 remains practically unchanged until its self-heated temperature reaches the Curie point of 170° C. and the large current continuously flows to the glow plugs 6. Thus, the energized temperature rise time of the glow plugs 6 becomes considerably faster. While the large current flowing continuously to the glow plugs 6 tends to cause their heat coils to burn out, the resistor unit 7 generates heat as the conduction time passes so that its temperature eventually attains the Curie point of FIG. 2 and the resistance value of the resistor unit 7 increases abruptly. As a result, the current flow to the glow plugs 6 is decreased rapidly and the heat coils of the glow plugs 6 are prevented from burning out.

When the resistance value of the starting resistor unit 7 increases abruptly (up to 10 ohms), the resistance value of the ordinary resistor unit 8 connected in parallel with the starting resistor unit 7 is now smaller (0.10 ohms) and consequently the current from the battery 1 flows to the glow plugs 6 through the ordinary resistor unit 8 and the temperature of the glow plugs 6 is maintained at the required value for the normal operation of the engine.

Next, the effect of disposing the ordinary resistor unit 8 in the intake air passage of the engine will be examined quantitatively. During the cranking period, the temperature of the glow plugs is high so that the current from the battery 1 flows mainly through the ordinary resistor unit 8. In this case, the resistance value of the ordinary resistor unit 8 is selected 0.1 ohms such that a voltage of about 5.5 volts is applied to the resistor unit 8, and consequently the generated heat quantity W of the resistor unit 8 is given by $W=(V^2/R)=(5.5^2/0.1)=302.5$ Joule/sec=72 cal/sec. Assuming that the engine is cranked in this condition, let us calculate the resulting temperature rise $\Delta T$ of the intake air. If the generated heat quantity W is entirely used in raising the temperature of the intake air, then we obtain $$W=\gamma \cdot Q \cdot C_p \cdot \Delta T$$

where $\gamma$ is the specific weight (kg/m$^3$),

Q is the flow rate (m$^3$/sec), $C_p$ is the specific heat at constant pressure (Kcal/kg·°C.).

Thus, if the flow rate Q is calculated on the basis of an engine displacement of 2200 cc and a cranking speed of 300 rpm and if the values of $\gamma$ and $C_p$ at 0° C. are substituted into the above equation to calculate the temperature rise value $\Delta T$, then the result is $Q=5.5\times10^{-3}$ m$^3$/sec $$\Delta T=\frac{W}{\gamma \cdot Q \cdot C_p}=\frac{72\times10^{-3}}{1.251\times5.5\times10^{-3}\times0.240}=43.6 \text{ deg.}$$

Thus the resulting temperature rise of the intake air is 43.6 degrees. This intake air temperature rise results in a considerable decrease in the cranking time. (The quantitative effect will be described later.)

Since the starting resistor unit 7 is contained in the metallic case 14 of good heat conduction as shown in FIG. 3 and since the case 14 is attached to the engine cylinder head or its vicinity, the temperature of the engine is sensed so that the current supplied to the glow plugs 6 through the resistor unit 7 is turned on and off in accordance with a time constant which is determined by the amount of heat generated by the resistor unit 7 and the amount of heat dissipated to the engine cylinder head or its vicinity.

Figure 10:
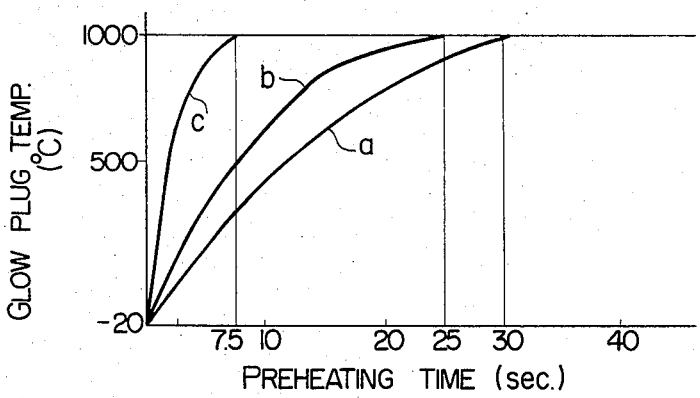
FIGS. 10 and 11 are characteristic diagrams useful for explaining the effects of the apparatus of this invention.

In this connection, the results of the experiments conducted by the inventors showed that a comparison between the prior art apparatus and the present embodiment of the invention in terms of the time required for increasing the glow plug temperature from −20° C. up to 1,000° C. are as shown in FIG. 10. In the prior art apparatus in which the glow plugs were directly connected to the battery through the switch, the terminal voltage of the glow plugs was 11 volts (9A) as compared with 6 volts (18A) in the present embodiment. In the prior art apparatus the resistance value of the glow plugs themselves was 1.2 ohms and that of the present embodiment was 0.40 ohms. The resistance value of the known molybdenum disilicide resistor unit was the same as disclosed in Japanese Utility Model Publication No. 48262/77. In FIG. 10, the line a shows the result of the prior art apparatus, the line b the result obtained with the known molybdenum disilicide and the line c the result of the present embodiment of the invention. As will be apparent from FIG. 10, the line c representing the present embodiment shows that the rise time required for the glow plug temperature to rise from −20° C. to 1,000° C. is about 7.5 seconds and this is remarkably fast as compared with 30 seconds of the line a and 25 seconds of the line b. Further, in accordance with the present embodiment the required energized temperature for operating the engine can be maintained through the action of the ordinary resistor unit 8 in the same manner as in the case of the prior art apparatus.

Figure 11:
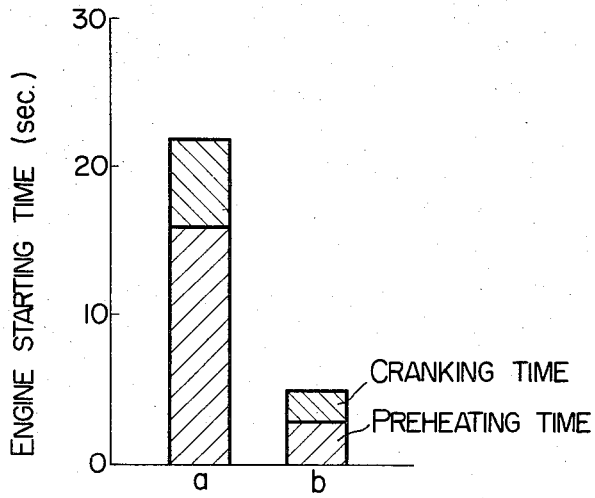

FIG. 11 shows in the form of a bar graph the improving effect on the engine starting time including the preheating time and the cranking time, and in the Figure the bar a represents the starting time of the prior art apparatus and the bar b represents that of the present embodiment of the invention. It will be seen that the preheating time (i.e., the time required for the glow plug surface temperature to reach 700° C. since this temperature is sufficiently high to effect the ignition) was improved from 16 to b 2 seconds and the starting time including both the preheating and cranking times was improved greatly from 24 to 5 seconds. Further, although not described in detail, if the apparatus of this invention is also used after the engine has started, the idling operation of the engine will be stabilized owing to the high temperature of the intake air and the amount of smoke (white smoke) consisting mainly of carbon and discharged from the exhaust pipe during the low engine temperature period will also be reduced considerably.

Figure 12:
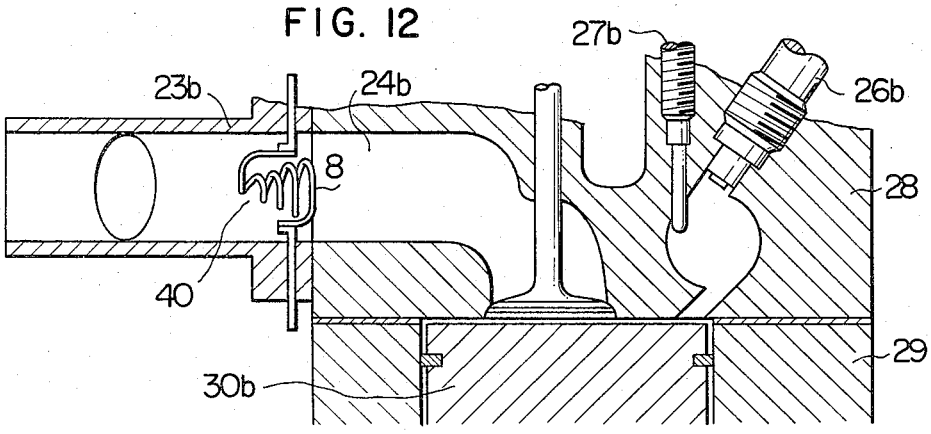
FIGS. 12 and 13 are sectional views of a Diesel engine, showing another embodiment of the present invention.

FIG. 12 shows another embodiment of the present invention which differs from the first embodiment in that the ordinary resistor unit 8 is divided into four elements which are respectively disposed at four positions between the intake manifold branches 23*a* to 23*d* and the intake ports 24*a* to 24*d* of FIG. 6 for the respective cylinders, and the elements are connected in parallel, series or combination of the both thus resulting in the total resistance of 0.10 ohms. In this case, although the number of the component parts forming the resistor unit 8 is increased by four times, the fact that the elements are positioned near the combustion chambers of the engine has the effect of reducing the amount of heat dissipated from the heated air to the wall surfaces and improving the efficiency. Each of the elements of the resistor unit 8 may be wound into a helical form (or a cylindrical form) as shown in FIG. 9. Of course, the mounting positions of the elements of the resistor unit 8 may be changed such that the elements are respectively mounted in the manifold branches 23*a* to 23*d* or the intake ports 24*a* to 24*d*.

Figure 13:
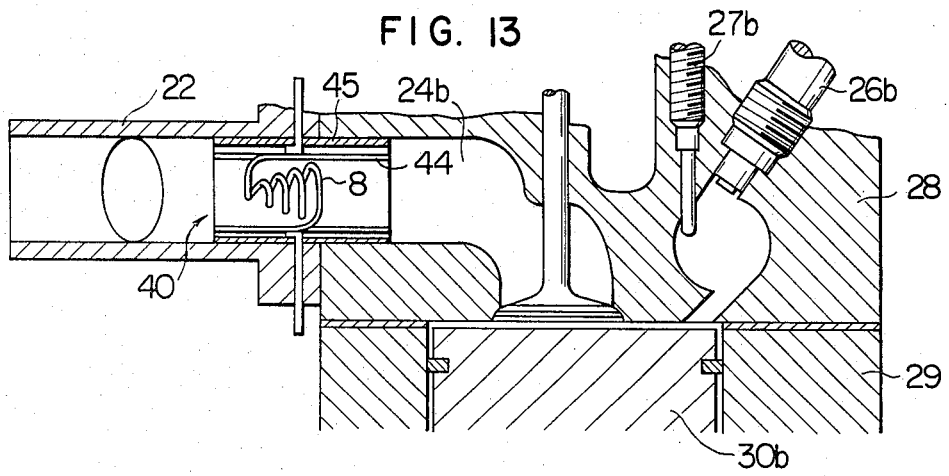

FIG. 13 shows still another embodiment of the invention which differs from the previously mentioned embodiments in that cylindrical covers 44 and 45 are provided to prevent the dissipation of heat energy to the wall surfaces by radiation or convection, and the cover 44 is made for example from a metallic material having a good heat conductivity to serve mainly the function of absorbing the radiation heat of the resistor unit 8 and transferring the absorbed heat to the intake air. The resistor unit 8 is mounted in the coverging portion 22. The cover 45 is made from a material having a good heat insulating property and mainly composed of plastic, Bakelite or asbestos and it serves the purpose of preventing the transmission of heat to the wall surfaces by radiation or convection. It is possible to obtain a considerable improvement with only one or the other of the covers 44 and 45.

Figure 14:
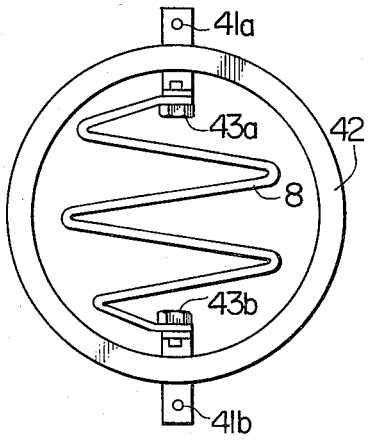
FIG. 14 is an assembly diagram showing another embodiment of the resistor 8.

FIG. 14 shows still another embodiment of the invention which differs from the previously mentioned embodiments in that the shape of the resistor unit 8 is modified into a wavy form as shown in the Figure.

While, in the embodiments described above, the resistance value of the ordinary resistor unit 8 is selected to be 0.10 ohms, it is needless to say that the resistance value varies in dependence on the resistance value and resistance temperature coefficient of the glow plugs. Also, all the values of the resistance and the Curie point of the starting resistor unit 7 fall within the scope of the invention as a matter of course so far as the values meet the purpose of the present invention. Also, the starting resistor unit 7 may be formed into a plate form, for example.

Figure 15:
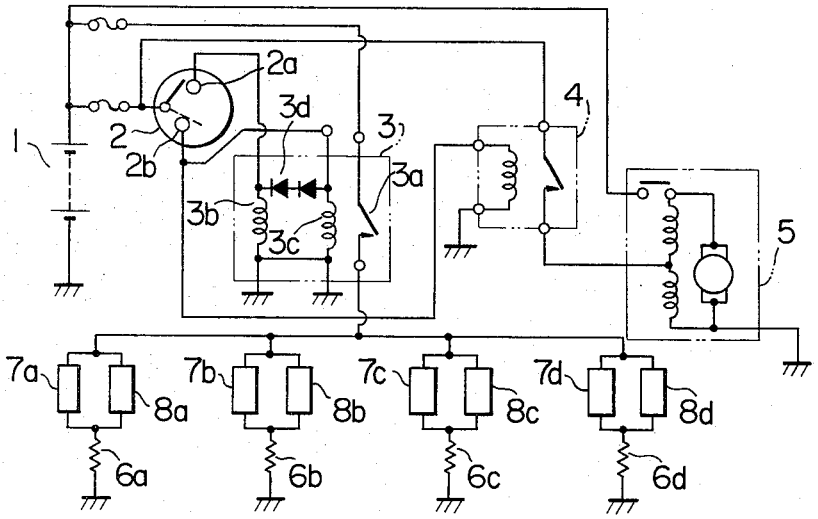
FIGS. 15 and 16 are wiring diagrams showing still other embodiments of the present invention.

FIG. 15 shows still another embodiment of the invention which differs from the previously mentioned embodiments in that starting resistor elements 7*a* and 7*d* and ordinary resistor elements 8*a* to 8*d* are respectively mounted in association with glow plugs 6*a* to 6*d*. With this embodiment, no difficulty will be caused if one of the glow plugs 6*a* to 6*d* is burnt out.

Figure 16:
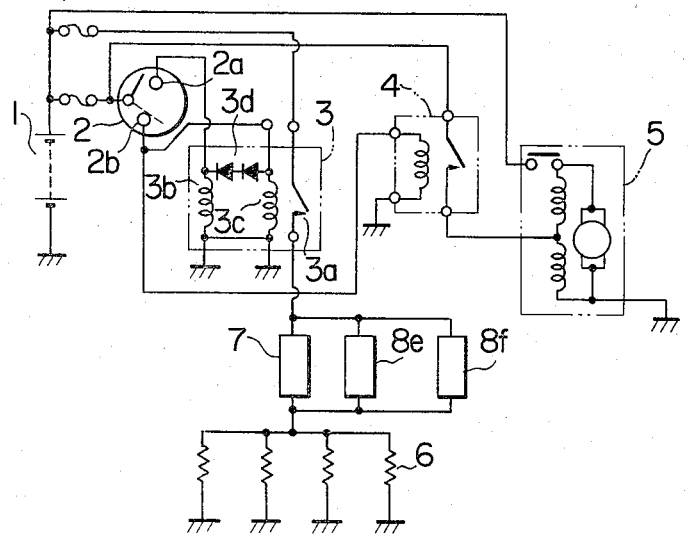

FIG. 16 shows still another embodiment of the invention which differs from the previously mentioned embodiments in that instead of mounting the whole ordinary resistor unit 8 in the intake air passage of the engine, the resistor unit 8 is divided into elements 8*e* and 8*f* such that as for example, the element 8*e* is used for intake air heating purposes and the element 8*f* is used as a glow plug controller. The combined resistance value of the elements 8*e* and 8*f* is selected for example to be 0.10 ohms as in the case of the previously mentioned embodiments.

We claim:

1. A preheating apparatus for Diesel engines, comprising:

a glow plug disposed in a cylinder-head of an engine;

starting resistor means connected between a voltage source and said glow plug, said starting resistor means including a resistance body principally composed of barium titanate for exhibiting a resistance characteristic of a positive resistance temperature coefficient and for abruptly increasing its resistance value at a predetermined temperature;

ordinary resistor means connected in parallel with said starting resistor means, and disposed in an intake air passage of said engine for heating the intake air flowing therethrough;

said starting resistor means exhibiting a resistance value smaller than that of said ordinary resistor means when a temperature of said glow plug is relatively low, and said starting resistor means exhibiting a resistance value larger than that of said ordinary resistor means when the temperature of said glow plug is relatively high; and a cylindrical cover made of a material having good heat insulating properties, said cylindrical cover being disposed in said intake air passage and surrounding said ordinary resistor means for preventing the transmission of the heat from said ordinary resistor means to a wall of said intake air passage.

2. A preheating apparatus for Diesel engines, comprising:

a glow plug disposed in a cylinder-head of an engine;

starting resistor means connected between a voltage source and said glow plug, said starting resistor means including a resistance body principally composed of barium titanate for exhibiting a resistance characteristic of a positive resistance temperature coefficient and for abruptly increasing its resistance value at a predetermined temperature;

ordinary resistor means connected in parallel with said starting resistor means, and disposed in an intake air passage of said engine for heating the intake air flowing therethrough;

said starting resistor means exhibiting a resistance value smaller than that of said ordinary resistor means when a temperature of said glow plug is relatively low, and said starting resistors means exhibiting a resistance value larger than that of said ordinary resistor means when the temperature of said glow plug is relatively high; and a cylindrical cover made of a material having good heat conductivity properties, said cylindrical cover being disposed in said intake air passage and surrounding said ordinary resistor means for absorbing the radiant heat of said ordinary resistor means and for transferring the absorbed heat to the intake air flowing through said intake passage.

3. An apparatus according to claim 2, further comprising a cylindrical cover made of a material having good heat conductivity properties, said cylindrical cover being disposed in said intake air passage and inside of said heat insulating cylindrical cover, and surrounding said ordinary resistor means for absorbing the radiant heat of said ordinary resistor means and for transferring the absorbed heat to the intake air flowing through said intake air passage.

4. An apparatus according to claim 1, 2 or 3, wherein the resistance material of said starting resistor means is substantially of honeycomb shape having a plurality of passages isolated from each other by a plurality of isolating walls each having an electrode film on its surface, and wherein said starting resistor means further includes:

positive contact electrode means and negative contact electrode means for contacting with said electrode films so that each of said isolating walls is inserted between each of said positive and negative contact electrode means pairs, to thereby allow current to flow through said walls in a direction perpendicular to the axes of said passages; and a metallic case for covering said resistance material.

5. An apparatus according to claim 4, wherein said ordinary resistor means is disposed in a converging portion of an intake manifold of said engine.

6. An apparatus according to claim 4, wherein said ordinary resistor means includes a plurality of ordinary resistors each being disposed in one of the branches of an intake manifold of said engine.

7. An apparatus according to claim 5, wherein said ordinary resistor means is wound into a helical form.

8. An apparatus according to claim 6, wherein each of said ordinary resistors is wound into a helical form.

9. An apparatus according to claim 4, wherein said ordinary resistor means includes a plurality of ordinary resistors at least one being disposed in an intake air passage of said engine.

* * * * *